United States Patent [19]

Abraham et al.

[11] 4,141,761

[45] Feb. 27, 1979

[54] HIGH STRENGTH LOW ALLOY STEEL CONTAINING COLUMBIUM AND TITANIUM

[75] Inventors: John K. Abraham, Broadview Heights; Peter J. Vander Arend, Brecksville, both of Ohio

[73] Assignee: Republic Steel Corporation, Cleveland, Ohio

[21] Appl. No.: 924,248

[22] Filed: Jul. 13, 1978

Related U.S. Application Data

[63] Continuation of Ser. No. 727,127, Sep. 27, 1976, abandoned.

[51] Int. Cl.[2] ..... C22C 38/06; C22C 38/12; C22C 38/14

[52] U.S. Cl. ..... 148/36; 75/123 J; 75/123 M; 75/124; 148/12 C

[58] Field of Search ..... 148/12 F, 12 C, 36; 75/123 R, 123 B, 123 J, 123 M, 124

[56] References Cited

U.S. PATENT DOCUMENTS

| | | | |
|---|---|---|---|
| 3,765,874 | 10/1973 | Elias et al. | 148/36 |
| 3,897,280 | 7/1975 | Gondo et al. | 148/12 C |
| 3,963,531 | 6/1976 | Elias et al. | 148/31.5 |

*Primary Examiner*—Arthur J. Steiner
*Attorney, Agent, or Firm*—Cooper, Dunham, Clark, Griffin & Moran

[57] ABSTRACT

High strength low alloy steels, produced as strip or the like by hot rolling, permit unusual economy of alloying ingredients while achieving superior mechanical properties, with a composition containing specifically low carbon and low manganese, and moderate proportions of both columbium and titanium, preferably with no requirement of silicon. Yield strengths in a range to and well above 80 ksi are attainable depending on the content of columbium and titanium, and good properties of formability are exhibited in the transverse direction. Processing conditions, for hot rolling and coiling, can be selected over reasonably convenient ranges of temperature conditions, while rolling load requirements are acceptable for products of various thicknesses. The steels are notably useful for thin strip, satisfying the usual mechanical property needs of such products with relatively low cost.

18 Claims, No Drawings

HIGH STRENGTH LOW ALLOY STEEL CONTAINING COLUMBIUM AND TITANIUM

This is a continuation of application Ser. No. 727,127 filed Sept. 27, 1976 now abandoned.

BACKGROUND OF THE INVENTION

This invention relates to high strength, low alloy (HSLA) steels having low carbon content and having good mechanical properties, i.e. by tensile and toughness measurements, particularly in respect to ductility and formability, for instance in exhibiting the ductility required for bending. The invention is particularly concerned with steel products which can be of the nature of sheet or the like, achieved by hot deformation; the contemplated products are thus made by hot rolling to desired thicknesses and shaped, notably strip, which can be used as so produced or as subsequently further reduced by cold rolling to sheet form, i.e. strip or the like, of thinner gauge.

The present improvements are notably designed to afford a steel of very low carbon content, with excellant properties in both longitudinal and transverse directions in reference to hot rolling. The steels are in the broad category defined by yield strengths of 60 ksi (60,000 pounds per square inch) and above, and in a particular sense the invention is concerned with steel products having yield strengths in the range of 70 ksi and higher, including a category of 70–80 ksi, and a category of greater strength, even up to 95 ksi. Indeed, a special aspect of the present invention resides in the provision of new and improved high strength low alloy steels, particularly as hot rolled strip, having yield strength of 80 ksi or better, preferably up to 90 ksi.

The demand for steel products of the nature described above rests to a considerable extent on increasing need for high strength in steel strip, sheet and the like, with a minimum of weight and, understandably, at as little cost as possible. For example, steels of this nature have many uses in vehicle constructions, particularly in the automotive area where for fuel economy it is desirable to reduce the weight of the structure, yet without impairing strength.

A basic purpose of HSLA steels of this class is therefore to achieve high strength properties, with a minimum of alloying elements and a minimum of processing expense. At the same time, however, it has been difficult to obtain satisfactory products in a variety of respects without employing a number of special elements for different purposes. Thus, high tensile properties and toughness can be obtained with additions of certain elements to steels of moderate to high manganese content and moderately low carbon, but avoidance of directionality in some of these properties, such as toughness and bendability, has usually required further additions, exemplified by rare earth elements, as well (in some cases) as special desulfurization.

Not only have the further additions, just mentioned, contributed to the cost of the described steels, but there appears to have been room for improvement in cost reduction even as to the quantity of other elements included. With previous efforts toward economy, useful HSLA steels have been difficult to attain at the higher strength levels and with realization of practical characteristics, e.g. such as nondirectionality, good toughness, and good weldability of the ultimate products. Attention is also needed to the problem of convenience in processing these steels, in hot rolling operations. In many cases of previous lower-cost HSLA compositions, very careful control has been required for finishing temperatures, coiling temperatures, and the like, within narrow ranges. Likewise, it has appeared that hot rollability is not always as good as might be desired, particularly in that some strength-promoting or other elements of the composition are believed to stiffen the hot band during hot rolling; if possible, there has been a need to reduce the hardness factor, now found to result, for example, from higher additions of columbium.

SUMMARY OF THE INVENTION

For the above and other purposes, and notably for attainment of high strength low alloy steel products having superior properties and yet characterized by economy of cost and ease of processing, the invention, in an important aspect, consists of steel characterized by additions of the microalloying elements columbium and titanium in low to moderate amounts, with critical, very low content of carbon and significantly low manganese, while preferably containing very little silicon, e.g. less than 0.1%.

With such propertions of elements, the balance of the steel being iron and incidental substances, and actual numerical ranges for the above elements and also maximum values for normal minor elements such as sulfur, nitrogen and phosphorus being as given hereinbelow, a paramount feature of the invention is the attainment of desired strength and formability in an unusually lean alloy, with respect both to the so-called microalloying metals and to elements such as magnanese and silicon.

In the new compositions, a first significant discovery is that the microalloying elements Cb and Ti can be employed with unusual effectiveness in a composition having a very low carbon content, e.g. not more than 0.07%, advantageously not over 0.06% (all percentages herein being by weight), and a low manganese content, being not above 0.6%, preferably not more than 0.5% and very preferably less than 0.5%. At these levels of carbon and manganese, it has been found that unusually high yield strengths are attainable with relatively moderate additions of columbium and titanium. In particular, it is found that lesser amounts of columbium as a strengthening agent can be employed with a significant quantity of less costly titanium, to achieve the above-mentioned strength levels in these low carbons, low Mn steels. This can be attained at low levels of nitrogen, such as less than 0.005% (weight percent).

A more specific finding is that in the new compositions, the yield strength is directly related to the sum of the percentages of these two elements Cb and Ti. Thus in the stated compositions, with the total of columbium and titanium at minimum percentages of 0.11, 0.14 and 0.16, it is possible to obtain minimum yield strengths (e.g. in both directions) of 70, 80 and 90 ksi, respectively, in the hot rolled products.

A second important aspect of the invention is that with the stated microalloyed compositions, especially having the prescribed or preferred levels of carbon and manganese, and with very little silicon, the rolled products are found to exhibit superior transverse formability and good toughness without special additions or processing. Heretofore in high strength low alloy steels, such properties have been markedly less satisfactory in the transverse direction (crosswise of the direction of rolling) than in the longitudinal or lengthwise direction of the rolling path. To correct such disparity, especially in strip materials having yield strengths of 60 ksi and over, so-called sulfide shape control additives exemplified by rare earths or zirconium, which increase the cost, have been used, and alternatively or in addition, the molten steel has been subjected to desulfurization, another item of expense. Whereas titanium has heretofore been reported to have some function or result in sulfide shape control (but not with the effectiveness of rare earth metals), the present steel products achieve both transverse formability improvement, and overall strength, by virtue of the defined composition. Whether there is a specific control of sulfide inclusions or some other effect in the steel, the products exhibit the stated improvement in transverse toughness and formability, without need to be concerned about inclusions.

One test of bendability is by press-brake forming to a sharp internal angle such as 60°, for determining the minimum inside radius of bend attainable without cracking, for example without edge cracking of cold-sheared specimens. The radius can be determined as a function or multiple of the specimen thickness T, such as 2T, 3T, etc. The products of this invention achieved a bend at least as sharp as a radius of 1T (both directions) at the 80 ksi strength level. Toughness is determinable with suitable Charpy V-notch (CVN) tests, conveniently using half-size CVN samples. With such tests, the so-called shelf energy ratio of the transverse-to-longitudinal directions for the higher strength materials of low alloy type heretofore available is normally less than 0.30 in the absence of sulfide shape control agents, but in all of the steels of this invention, observed nondirectionality of microstructure will lead to higher values for such ratios.

As indicated above, a third attribute of the invention, notably in its preferred embodiments, is a very low total alloying content, with correspondingly lower overall cost of the final product in comparison with prior, formable steels of like high strength and so-called low alloy type.

These improved steels not only achieve high yield strengths but are found to exhibit good toughness and excellent bendability in the transverse direction, to levels comparable to a number of various prior 60 to 80 ksi HSLA steels that have been regarded as normal. In contrast, moreover, with prior use of higher carbon and especially, higher manganese levels in HSLA steels, it is now found that neither C nor Mn is needed, at such levels, either for solid solution strengthening or for lowering the transformation temperature to promote fine ferrite grain size.

The steels of the invention are readily hot-rolled, without excessive rolling loads and with exhibition of relatively low or moderate hardness factors.

Finally, the new products as defined are found to permit useful ranges of processing conditions, i.e. as to finish temperature for the hot rolling sequence, and as to coiling temperature for the completed strip, in contrast to the high sensitivity of many steels of this class to particular temperatures for desired results. Although the present steels have a progressive and considerable increase (e.g. by 10 to 15 ksi) in yield strength as the hot rolling finish temperature is increased from 1550° F. to 1750° F., it is conveniently possible to achieve target values (or better) in yield strength over a range of finishing temperature, e.g. 1650° to 1750° F., that is easy to control for a target of 1700° F., and over a good range of coiling temperature, e.g. 1050° to 1200° F. In consequence, practical production of these alloys on a hot strip mill is facilitated, especially through a wide range of thicknesses, as from 0.5 inch to 0.07 inch, notably in the thinner gauges, as below 0.2 inch. Attainment of uniform properties throughout each coil is well attainable.

Briefly summarized as to broader ranges of composition the new products contemplate a hot-rolled steel product, e.g. so reduced by at least about 50%, which contains: over 0.02%, preferably from 0.03%, to 0.07% carbon, advantageously to 0.06% C; 0.3 to 0.6% Mn; silicon less than 0.2%, very preferably 0 to 0.1% Si; 0.05 to 0.12% Cb, preferably not more than 0.10%; 0.06 to 0.15% Ti, very advantageously not higher than 0.12% Ti; and total Cb + Ti, 0.11% and above, depending on required yield strength, but usually not more than about 0.22% even for 90 ksi.

The steels also preferably contain not more or less than certain amounts of minor elements, as for example 0.01% min. Al, 0.03% max. sulfur, and 0.03% max. phosphorus. Ordinarily, sulfur can be not less than 0.025% without special de-sulfurization, and as indicated, such treatment is not ordinarily required for achieving nondirectionality in the present steels. In practice, it appears that sulfur content may conveniently range from 0.008 (or less) to 0.02%, aluminum from 0.02 to 0.07%, or up to 0.09%, and phosphorus from less than 0.01 to 0.015%. While nitrogen content may range as high as 0.015%, an advantage of the invention is that ordinarily, special provision for nitrogen need not be made, and full advantages can be expected with nitrogen in the range of 0.007% and below, e.g. to 0.003%. The steel is very preferably aluminum-killed — such operation being performed in conventional manner and for conventional purposes.

DETAILED DESCRIPTION

The steels of the invention having compositions within the ranges stated above, or indeed within more specific ranges related to particular and notably advantageous aspects of the invention, are prepared in an essentially conventional way, e.g. for making a very low carbon, low alloy steel, following known practices for producing a clean ingot product, with good control of desired contents of small percentages of alloying elements. Thus the basic melt is achieved in a customary manner, as in a standard electric or basic oxygen furnace, appropriate attention being paid to the desired low carbon content. It is understood that carbon levels as low as 0.03% or slightly lower are effectively obtainable without special treatment of the melt after tapping, and indeed the carbon ranges contemplated as preferred for the present steels appear to pose no special problem in melting practice.

Additions of the several required elements to the basic charge of scrip, iron and the like are made in the manner appropriate for such materials. To the extent that the desired low level of manganese is not inherently present in the charge, this element may be added in the furnace and/or ladle, e.g. as ferromanganese. Very preferably the minor, i.e. microalloy additions, Cb and Ti, are effected by adding appropriate material, for example as ferroalloys, to the melt in the ladle after tapping. There is ordinarily no need to add silicon or, as explained above, to introduce additional nitrogen into the melt.

It is greatly preferred that the steel compositions of the invention be fully de-oxidized; although other deoxidation practice may be used, satisfactory results are achieved by the usual killing with aluminum. Thus aluminum can be added to the ladle for de-oxidizing so that oxygen is reduced to values, for example, less than 0.005%.

After pouring the steel of the melt, which has been suitably controlled as to content of the several required elements, the resulting ingots are handled in conventional way, being reduced to slab or the like for final reduction by hot deformation. For most purposes, this is effected by hot rolling, for example through the requisite number of passes, to a selected finish temperature. A special advantage of the invention is that this finish temperature may be chosen or controlled within a usefully wide range, for example from 1650° to 1750° F. without particular regard to the precise composition as to microalloy elements, and while assuring yield strength well over a selected approximate minimum. It appears that increase of yield strength with increase of finish temperature is not of great significance over the stated range.

The product delivered by the hot mill at the selected or determined temperature within the above range, being strip or other shape as sheet or the like, is appropriately cooled to a selected temperature. Such cooling may be at a rate of 15° to 135° F. per second (with air, or with water spray or jet if needed), in accordance with known procedure for these types of steel. The selected temperature to be reached thus for coiling or other collecting of the hot-rolled material (including piling of sheets) may be in the range of 1050° to 1200° F. After such collection, e.g. after the coiling of strip, the product can be allowed, in usual fashion, to cool very slowly. As in the case of the finish temperature, this coiling temperature may vary within the range without substantial effect upon, or other than very minor relation to, the desired yield strength of the product; strength properties are thus determinable essentially wholly by the elemental composition. In fact, a valuable aspect of the invention is that at prescribed levels of carbon and manganese, and with both elements Cb and Ti present, in amounts of at least 0.05% of each, the strength properties of the product are primarily determined by the total quantity of these microalloying elements.

The improved high strength, low alloy steels can be produced, as hot rolled product, in a usefully wide variety of gauges, for instance from about 0.07 to 0.5 inch. The invention is particularly useful in the lower part of the range, e.g. up to about 0.2 inch, and very notably in the range of about 0.07 to 0.1 inch, in that the lighter gauge products in many cases are not required to have the very high toughness available with other HSLA steels that are more costly in one or more of the microalloying elements used. In other words, the invention has a substantial economic advantage. The products are readily hot rolled, without excessive rolling loads and with exhibition of relatively low or moderate hardness factors.

The new steel products have been tested through a significant range of compositions, with experimental results fully supporting the properties and characteristics described herein. In the main, the tests involved heats in an induction heated furnace suitable for pouring 100-pound ingots, under laboratory operation. The base chemistry of the material produced was about that of SAE 1006-grade steel with very low phosphorus and sulfur levels, the specific content of elements being as indicated below. These laboratory heats were air-induction melted and were fully de-oxidized with aluminum prior to pouring into the 100-pound ingots.

The ingots were hot reduced and ultimately processed by hot mill rolling, in the manner of hot strip production, i.e. yielding, after a series of passes, a product of thickness of the order of 0.1 inch. Finish temperatures for the hot rolling were varied between 1550° and 1750° F. Although somewhat higher strength properties were achieved at the higher finish temperatures, the difference was generally small, through the upper part of the range, e.g. 1650° to 1750° F., affording amply convenient flexibility of control for commercial processing to achieve a selected minimum target strength.

In these tests, the strip samples were cooled at a rate of about 40° to 50° F. per second to a selected coiling temperature, and were thereafter collected at such temperature, by coiling or in a manner to simulate coiling. These collecting temperatures were varied over a range of 1000° to 1340° F., it being found that variation in properties was relatively small over a presently preferred, reasonably wide range, e.g. approximately 1050° to 1250° F.

Specimens from the several experimental products, i.e. after the completed strip had cooled to room temperature, were subjected to tests of mechanical properties, e.g. tensile properties, impact strength (CVN) and bendability. Unless otherwise indicated, it will be noted that in all cases, yield strength was tested as the conventional 0.2% offset determination, in the longitudinal direction of the sample. Inasmuch as yield strength is almost invariably lower in the longitudinal than in the transverse direction, the determinations of yield strength can be considered to represent values at least as high as are found in both directions of the rolled product. Tests of impact strength and of bendability were made in conventional ways.

A number of steel compositions were produced in the foregoing manner, of which significant examples are set forth in the following table (values in weight percent):

| Steel No. | C | Mn | Si | Cb | Ti | Al | Cb+Ti |
|---|---|---|---|---|---|---|---|
| 1 | 0.057 | 0.40 | 0.05 | 0.05 | 0.09 | 0.02 | 0.14 |
| 2 | 0.052 | 0.38 | 0.05 | 0.05 | 0.14 | 0.03 | 0.19 |
| 3 | 0.05 | 0.35 | 0.04 | 0.09 | 0.08 | 0.02 | 0.17 |
| 4 | 0.054 | 0.35 | 0.02 | 0.10 | 0.14 | 0.02 | 0.24 |

These have been identified, solely for reference herein, by the consecutive numbers in the left-hand column. In all cases, the content of phosphorus was less than 0.008%, the sulfur content was about 0.008%, and nitrogen was about 0.005%, as will be understood, the balance of the compositions consisted of iron and incidental impurities. These steels were all, of course, aluminum killed. Tests have demonstrated that the sulfur content was not critical in most cases and could go up to 0.02% or in some cases even 0.025% without introducing undesired directionality in the properities of toughness and formability. Although phosphorus and nitrogen respectively to 0.03% and 0.015 could be tolerated, good practice and emminently satisfactory results were had with low values of each of these elements, i.e. a maximum P of about 0.015% and of N about 0.01%.

The total of columbium and titanium for each of the above heats is also listed, and it was found from the foregoing and other evidence that the strength category, i.e. in yield strength, of these products could be directly correlated with the microalloy total. Indeed, all of the heats in the table were in the range above 80 ksi, specifically affording yield strengths in all cases above 85 ksi, and ranging to a level of more than 90 ksi for heat No. 4. As explained below, a presently preferred and in fact special aspect of the invention resides in compositions exemplified by heats Nos. 1 and 3, wherein the titanium content is not greater than 0.12%. It has been found that lower but nevertheless useful values of yield strength can be achieved with leaner contents of the miroalloying elements; for example, compositions like those in the table, but having 0.05 to 0.07% Cb and 0.06 to 0.08% Ti assure a yield strength value above 70 ksi.

All of these steels showed acceptable properties of toughness and formability. The measured properties were satisfactory (as indicated above), including actual toughness values in the transverse direction, that can be considered good for HSLA steels. Transverse bendability was good, ranging no higher than about 1T for the higher yield strength products.

The alloys attain unusual advantages, particularly in mechanical properties and lack of directionality, with notably low expense and ease of processing. The products, moreover, represent an unusually clean steel, have good surface properties, and are capable of satisfactory welding, e.g. by spot welding and in other ways. Yield strengths above 80 ksi are readily attainable; indeed, the compositions disclosed herein for such purpose can be considered as a special area of the invention. For such products, it is preferable, especially to reach 85 ksi or better, that the carbon content be at least about 0.045%, in order to assure best realization of the contributions of columbium and titanium. As indicated, the silicon content of all the above examples of the invention is very advantageously quite low, but it is conceived that some high strength products may constitute new and useful compositions even with silicon up to 0.4%.

Although products of some utility can be made with titanium content up to 0.15% with careful control of processing, it is of special advantage not to exceed 0.12%. For example, tests indicated that products from heats Nos. 2 and 4 of the above table (with 0.14% Ti) were apt to be sensitive to coiling temperature, in that at higher values of the latter (e.g. above 1200° F. where the finish temperature was below 1650° F.), the yield strength decreased materially from desired values.

Although the steels are conveniently defined by their properties as produced by the hot rolling, coiling and cooling procedure, it will be understood that an ultimate product embodying a steel of the invention may have had further processing that affects the value of a property, for example decrease in yield strength upon cold rolling and annealing.

It is to be understood that the invention is not limited to the specific features herein set forth for example but may be carried out in other ways without departing from its spirit.

We claim:

1. A hot rolled, high strength, aluminum killed steel product as reduced by hot rolling in which the final reduction by such hot deformation is to a finish temperature above 1550° F., said product having yield strength of more than 60 ksi as so produced, and having minimum bendability, in each direction, no higher than 1T for a thickness T of 0.1 inch, said steel consisting essentially of 0.03 to 0..06% C, 0.3 to 0.6% Mn, 0.05 to 0.12% Cb, 0.06 to 0.15% Ti, 0 to less than 0.2% Si, 0.01 to 0.1% Al, and from 0 to the following maximum percentages of the following elements: 0.03 max. P, 0.025 max. S, 0.015 max. N, balance iron and incidental elements.

2. A steel product as defined in claim 1, which has yield strength of at least 70 ksi.

3. A steel product as defined in claim 1, which has yield strength of at least 80 ksi, and in which the total of Cb and Ti is at least 0.14%.

4. A steel product as defind in claim 1, which contains 0.3 to 0.5% Mn.

5. A steel product as defined in claim 4, which contains 0 to 0.1% Si and 0 to 0.02% max. S.

6. A steel product as defined in claim 4, which contains 0.04 to 0.06% C.

7. A steel product as defined in claim 1, which has yield strength of at least 90 ksi and contains 0 to 0.1% Si, and in which the total of Cb and Ti is at least 0.16%.

8. A hot rolled, high strength, aluminum killed steel product as reduced by hot rolling in which the final reduction by such hot deformation is to a finish temperature above 1550° F., said product having yield strength of at least 80 ksi as so produced, and having minimum bendability, in each direction, no higher than 1T for a thickness T of 0.1 inch, said steel consisting essentially of 0.03 to 0.06% C, 0.3 to 0.5% Mn, 0.05 to 0.12% Cb, 0.07 to 0.15% Ti, 0 to less than 0.2% Si, the total of Cb and Ti being at least 0.14%, 0.01 to 0.2% Al, and from 0 to the following maximum percentges of the following elements 0.03 max. P, 0.025 max. S, 0.015 max. N, balance iron and incidental elements.

9. A steel product as defined in claim 8, which contains 0 to 0.02% max. S.

10. A steel product as defined in claim 9, which contains 0.04 to 0.06% C and 0.3 to 0.45% Mn.

11. A steel product as defined in claim 9, which contains from 0 to the following maximum percentages of the following elements 0.015 max. P, 0.01 max. N.

12. A steel product as defined in claim 9, which contains 0 to 0.1% Si and 0.02 to 0.07% Al.

13. A steel product as defined in claim 8, which contains 0.045 to 0.06% C, 0.06 to 0.12% Cb, and a total of Cb and Ti of at least 0.16%.

14. A steel product as defined in claim 13, which contains a total of Cb and Ti of least 0.18%.

15. a steel product as defined in claim 8, which contains 0.003 to 0.01% N.

16. A hot rolled, high strength, aluminum killed steel product as reduced by hot rolling in which the final reduction by such hot deformation is to a finish temperature above 1550° F., said product having yield strength of more than 60 ksi as so produced, and having minimum bendability, in each direction, no higher than 1T for a thickness T of 0.1 inch, said steel consisting essentially of 0.3 to 0.07% C, 0.3 to 0.6% Mn, 0.05 to 0.12% Cb, 0.06 to 0.15% Ti, 0 to 0.4% Si, 0.01 to 0.2% Al, and from 0 to the following maximum percentages of the following elements 0.03 max. P, 0.03 max S, 0.015 max. N, balance iron and incidental elements.

17. A steel product as defined in claim 16, which contains 0.3 to 0.5% Mn.

18. A steel product as defined in claim 17, which contains 0.03 to 0.06% C, and 0 to 0.1% Si, and the following are the maximum percentages of the following elements 0.015 max. P, 0.020 max. S, 0.01 max. N.

* * * * *

UNITED STATES PATENT AND TRADEMARK OFFICE

CERTIFICATE OF CORRECTION

PATENT NO. : 4,141,761

DATED : February 27, 1979

INVENTOR(S) : JOHN K. ABRAHAM ET AL.

It is certified that error appears in the above-identified patent and that said Letters Patent are hereby corrected as shown below:

Column 1, line 18, delete "shaped" and insert -- shapes --.

Column 1, line 23, delete "excellant" and insert -- excellent --.

Column 2, line 47, delete "carbons" and insert -- carbon --.

Column 6, line 52, delete "," (comma) (first occurrence) and insert -- ; -- (semicolon).

Column 8, line 29 (Claim 8), delete "percentges" and insert -- percentages --.

Column 8, line 55 (Claim 16), delete "0.3" (first occurrence) and insert -- 0.03 --.

Signed and Sealed this

*Eighteenth* Day of *December 1979*

[SEAL]

*Attest:*

SIDNEY A. DIAMOND

*Attesting Officer*

*Commissioner of Patents and Trademarks*